US005234660A

United States Patent [19]

Simko, Jr.

[11] Patent Number: 5,234,660

[45] Date of Patent: Aug. 10, 1993

[54] INSULATING CERAMIC FIBER BATTING MODULE, ANCHORING SYSTEM, LADLE COVER ASSEMBLY AND METHOD OF ASSEMBLY

[75] Inventor: Joseph S. Simko, Jr., Highland, Ind.

[73] Assignee: Simko & Sons Industrial Refractories, Inc., East Chicago, Ind.

[21] Appl. No.: 904,750

[22] Filed: Jun. 25, 1992

Related U.S. Application Data

[62] Division of Ser. No. 595,295, Oct. 10, 1990.

[51] Int. Cl.[5] ..... C21B 5/44

[52] U.S. Cl. ..... 266/286; 52/506

[58] Field of Search ..... 266/280, 286, 275, 283; 52/506, 509, 512, 504

[56] References Cited

U.S. PATENT DOCUMENTS

| | | | |
|---|---|---|---|
| D. 291,118 | 7/1987 | Miller et al. | 220/215 |
| 2,122,032 | 5/1938 | Goldberg et al. | 266/275 |
| 3,140,792 | 7/1964 | Harris | 220/215 |
| 3,292,326 | 12/1966 | Holzwarth | 266/280 |
| 3,591,152 | 7/1971 | Mills, Jr. | 263/46 |
| 3,743,132 | 7/1973 | Larker et al. | 220/40 R |
| 3,819,468 | 6/1974 | Sauder et al. | 161/152 |
| 3,832,815 | 9/1974 | Balaz et al. | 52/404 |
| 3,840,425 | 10/1974 | Finelli et al. | 161/68 |
| 3,854,262 | 12/1974 | Brady | 52/404 |
| 3,892,396 | 7/1975 | Monaghan | 266/280 |
| 3,916,057 | 10/1975 | Hatch et al. | 428/236 |
| 3,940,244 | 2/1976 | Sauder et al. | 432/247 |
| 3,952,470 | 4/1975 | Byrd, Jr. | 52/509 |
| 3,990,203 | 11/1976 | Greaves | 52/227 |
| 4,001,996 | 1/1977 | Byrd, Jr. | 52/509 |
| 4,083,155 | 4/1978 | Lampert | 52/509 |
| 4,088,825 | 5/1978 | Carr | 266/286 |
| 4,102,103 | 7/1978 | Marcmann | 52/506 |
| 4,103,469 | 8/1978 | Byrd, Jr. | 52/509 |
| 4,123,886 | 11/1978 | Byrd, Jr. | 52/509 |
| 4,168,013 | 9/1979 | King et al. | 266/264 |
| 4,177,036 | 12/1979 | Sauder | 432/247 |
| 4,177,616 | 12/1979 | Lampert | 52/509 |
| 4,195,457 | 4/1980 | Kissling et al. | 52/224 |
| 4,246,852 | 1/1981 | Werych | 266/283 |
| 4,273,879 | 6/1981 | Langer et al. | 521/91 |
| 4,276,332 | 6/1981 | Castle | 428/36 |
| 4,287,839 | 9/1981 | Severin et al. | 266/286 |
| 4,336,086 | 6/1982 | Rast | 52/506 |
| 4,339,902 | 7/1982 | Cimochowski et al. | 52/506 |
| 4,364,210 | 12/1982 | Fleming et al. | 52/221 |
| 4,381,634 | 5/1983 | Hounsel et al. | 266/286 |
| 4,405,055 | 9/1983 | Koerdt et al. | 220/215 |
| 4,411,621 | 10/1983 | Miller | 52/404 |
| 4,419,535 | 12/1983 | O'Hara | 174/48 |
| 4,425,749 | 1/1984 | Parker | 52/509 |
| 4,481,746 | 11/1984 | Cimochowski | 52/506 |
| 4,524,702 | 6/1985 | Miller et al. | D23/72 |
| 4,530,441 | 7/1985 | Miller et al. | 52/404 |
| 4,580,974 | 4/1986 | Braschler | 432/250 |
| 4,606,473 | 8/1986 | Miller et al. | 220/215 |
| 4,628,657 | 12/1986 | Ermer et al. | 52/509 |
| 4,640,202 | 2/1987 | Schraff et al. | 52/404 |
| 4,647,022 | 3/1987 | Coble | 266/282 |
| 4,791,769 | 12/1988 | Miller | 432/247 |
| 4,829,734 | 5/1989 | Schraff | 52/506 |
| 4,863,146 | 9/1989 | Briemont | 266/252 |
| 5,014,482 | 5/1991 | Alexander | 52/506 |
| 5,065,987 | 11/1991 | Hounsel | 266/283 |
| 5,118,085 | 6/1992 | Forte et al. | 266/275 |

*Primary Examiner*—Scott Kastler

*Attorney, Agent, or Firm*—Richard G. Kinney

[57] ABSTRACT

A lightweight ladle cover employing ceramic fiber mats in modules. The modules are formed by having the generally rectilinear mat folded into five adjacent sections, the first of which depends vertically toward the "hot" side of the cover but is sandwiched between the second, third and fourth sections which form a vertical, horizontal ("hot" side) and vertical U-shape configuration about the first section. The last section is folded to extend horizontally to overlay part of the next module. The modules are anchored to an expanded metal wall at the "cold" side of the cover by an anchoring system which employs flat bars with spaced apart threaded studs welded to one flat side of the bar. In assembly, the studs are pierced through the mat at the junction of the first and second sections and then passed through openings in the expanded metal wall and secured by a washer and nut arrangement. The modules are then held by two bar-stud assemblies. The modules can be assembled by the process of laying down successive mats, securing them with anchoring assemblies, folding them in place and then repeating the process.

5 Claims, 5 Drawing Sheets

INSULATING CERAMIC FIBER BATTING MODULE, ANCHORING SYSTEM, LADLE COVER ASSEMBLY AND METHOD OF ASSEMBLY

This is a division of application Ser. No. 07/595,295, filed Oct. 10, 1990.

FIELD OF THE INVENTION

The present invention relates to insulated furnaces, ladle covers and like insulated structures. More particularly, it relates to a new and improved system and method for securing or anchoring a ceramic fiber batting mat to a back or "cold" wall to form a novel insulating module, assembly and structure.

BACKGROUND OF THE INVENTION

Ceramic fiber insulation has been widely adopted in the steel making and in other industries which handle molten metal. It is employed for making heat retentive ladle covers and furnace walls. The following references illustrate prior suggestions and practices in this field: Briemont, U.S. Pat. No. 4,863,146; Schraff, U.S. Pat. No. 4,829,734; Miller, U.S. Pat. No. 4,791,769; Coble, U.S. Pat. No. 4,647,022; Schraff, et al., U.S. Pat. No. 4,640,202; Miller, et al., U.S. Pat. No. 4,606,473; Braschler, U.S. Pat. No. 4,580,974; Miller, et al., U.S. Pat. No. 4,530,441; Miller et al., U.S. Pat. No. 4,524,702; Cimochowski, U.S. Pat. No. 4,481,746; Parker, U.S. Pat. No. 4,425,749; Miller, U.S. Pat. No. 4,411,621; Hounsel, et al., U.S. Pat. No. 4,381,634; Cimochowski, U.S. Pat. No. 4,339,902; Rast, U.S. Pat. No. 4,336,086; Severin, U.S. Pat. No. 4,287,839; Werych, U.S. Pat. No. 4,246,852; Sauder, U.S. Pat. No. 4,177,036; King, U.S. Pat. No. 4,168,013; Byrd, Jr., U.S. Pat. No. 4,123,886; Byrd, Jr., U.S. Pat. No. 4,103,469; Carr, U.S. Pat. No. 4,088,825, Lampert, U.S. Pat. No. 4,083,155; Byrd, Jr., U.S. Pat. No. 4,001,996; Greaves, U.S. Pat. No. 3,990,203; Byrd, Jr., U.S. Pat. No. 3,952,470; Sauder, U.S. Pat. No. 3,940,244; Hatch, et al., U.S. Pat. No. 3,916,057; Monaghan, U.S. Pat. No. 3,892,396; Brady, U.S. Pat. No. 3,854,262; Balaz, U.S. Pat. No. 3,832,815; Sauder, et al., U.S. Pat. No. 3,819,468; Mills, Jr., U.S. Pat. No. 3,591,152; French Patent Publication No. 2,388,197; U.K. Patent Application No. 2,112,119A; U.K. Patent Application No. 2,034,867A; U.K. Patent Application No. 2,004,626A; U.K. Patent Specification No. 1,555,459; European Patent Publication No. 0,010,444; and Miller, U.S. Pat. No. De. D291,118.

SUMMARY OF THE INVENTION

Despite the considerable variety of previous approaches, there still exists the need for an easily assembled furnace wall or ladle cover structure which securely attaches modules of ceramic fiber batting to the structure so as to minimize heat transfer by hot gas through the matrix of modules and yet is economical in use of materials and labor.

A ladle cover or like heat insulating structure constructed in accordance with the present invention would include a frame with a volume to be filled with ceramic insulating batting material. An expanded metal or like wall defines one side of the volume. A ceramic insulating assembly including a plurality of adjacent modules, each of which is formed from a unitary mat of ceramic batting, is provided to fill the volume. The successive modules are formed by having a mat folded to have successive sections arranged with an end section extending vertically at approximately a right angle to the wall and surrounded by an adjacent vertical section of its mat on one side, by a third section at the end of said first section, and by a vertical fourth section of its mat on its other side. The second, third and fourth sections being folded into a generally U-shape cross section, with the first section being sandwiched between the second and fourth sections and received in the opening of the U. A final section of the mat is folded horizontally at an approximately right angle from said fourth section, said final section being adjacent the wall and extending a sufficient distance therealong so as to overlay the first, second and third sections of the next adjacent module in that direction. The assembly also includes suitable means for securing the modules to the wall.

A second feature of the invention relates to a novel anchoring unit for securing folded ceramic insulating mats to a cold side wall of a ladle cover or like structure. The wall is preferably of expanded metal or otherwise defines a plurality of openings. The anchoring unit constructed in accordance with the principles of the present invention includes a flat metal bar having a length many times its width, a thickness much less than its width and an upper flat surface. It also includes a plurality of studs, one end of each stud being secured to the upper surface of the bar at spaced intervals along the length of the bar. The studs are long enough to pierce and pass through the ceramic mat and through openings in the wall wherein they can be captivated to hold the bar and mats in place against the wall.

Another feature of the invention relates to the process of making a heat insulating assembly for a ladle cover or like insulating structure having a wall. The process employs a plurality of mats of spun ceramic fiber material capable of being folded between a plurality of adjacent sections. The process also employs a plurality of anchor units made of elongated bars having elongated studs secured in a spaced array along the bars, the studs having one longitudinal end secured to the bar and the other end adapted to receive a fastener, all of the studs secured to a bar being aligned with one another and projecting in the same direction on the same side of the bar. The process includes the steps of placing a mat against the end section of another mat, which end section is against the wall, said placed mat being positioned so that the junction between its first end section and second section are against the cold side of said end section of the mat section against the wall. Placing the anchoring unit along the junction of the placed mat and pushing the studs thereof through both said placed mat and the mat section against the wall to pierce both to pass into the wall. Then securing the studs of the anchoring unit passed into the wall and fastened so as to sandwich both mats between the wall and the bar of the anchoring unit. Then the first section of the newly placed mat is folded to extend away from the wall in an approximately vertical arrangement while folding the next adjacent sections of the mat into a generally U-shape about the end section and placing the other end section of the mat horizontally against the wall to form a section for receiving another mat. And repeating these steps to form adjacent modules until the assembly is substantially formed.

The invention, together with further advantages and features thereof, may best be understood by reference to the following description taken in connection with the accompanying drawings, in the several figures of which, like reference numerals identify like elements.

DETAILED DESCRIPTION OF ONE PREFERRED EMBODIMENT

Figure 1:
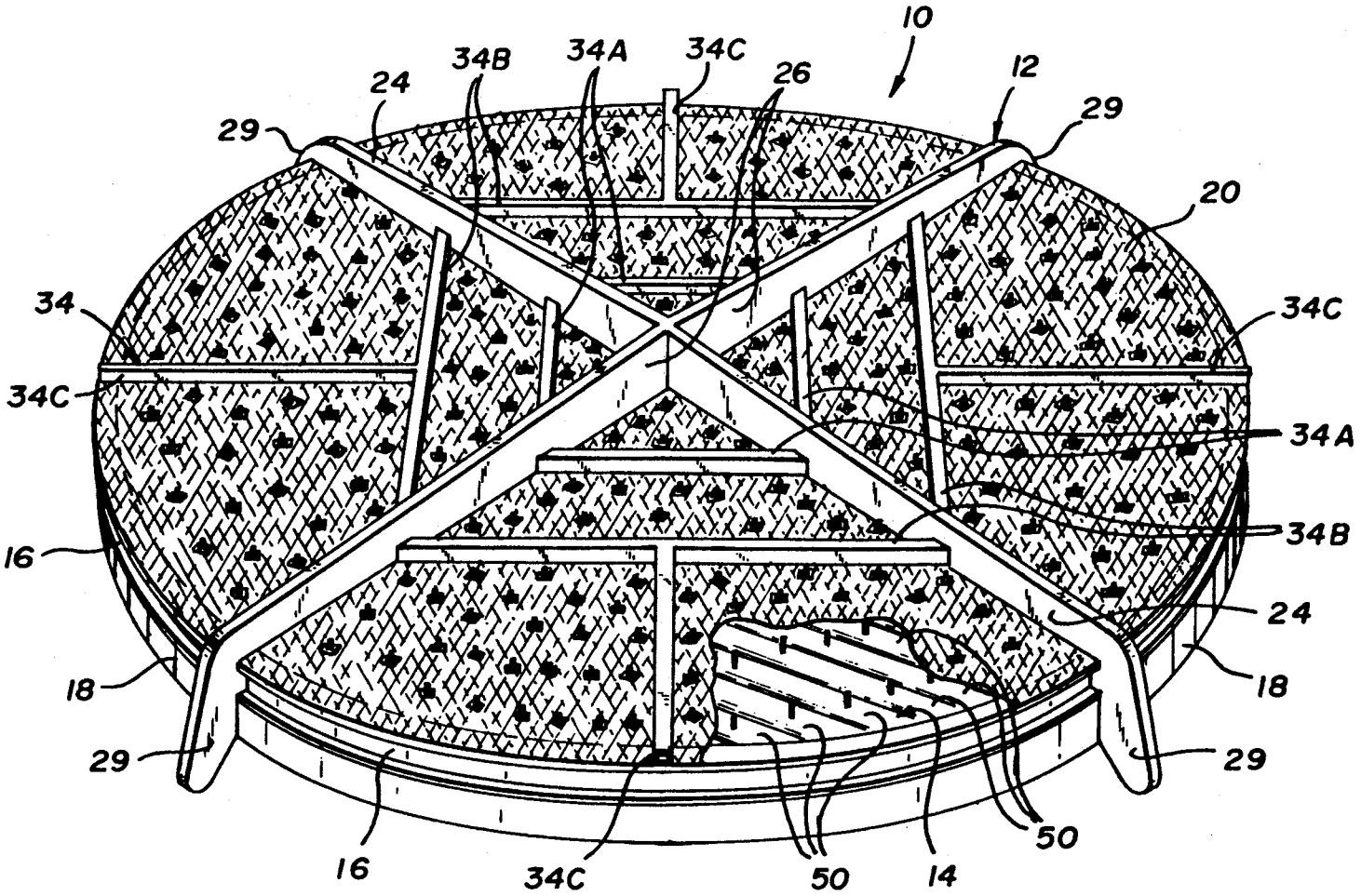
FIG. 1 is a perspective view, partly broken away, of a ladle cover constructed in accordance with the principles of the present invention. For convenience in representation of some small parts (i.e. projecting studs and fasteners), only a representative number of these parts are depicted.
Figure 2:
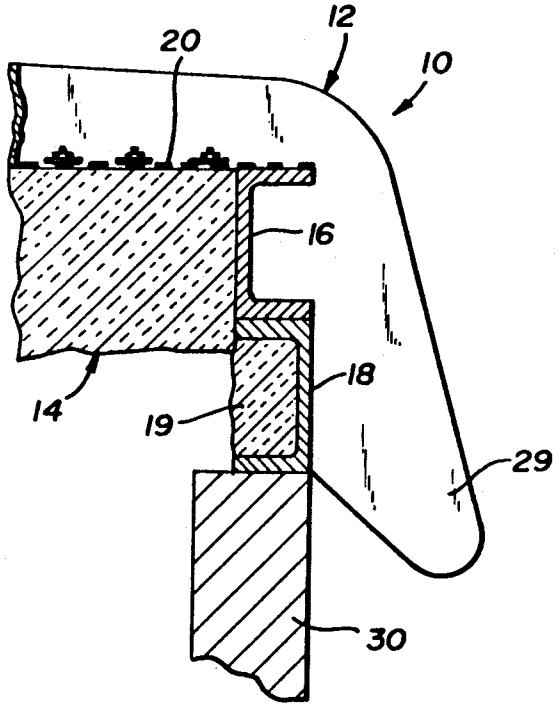
FIG. 2 is a partial sectional view of the cover of FIG. 1 (larger scale than that of FIG. 1) positioned atop a ladle.

Referring to FIG. 1, there is depicted a ladle cover which is constructed in accordance with the principles of the present invention and is generally indicated by the number 10. The cover 10 includes a framework 12 and a lightweight insulating assembly 14 of a novel construction which is secured to the framework 12. The framework includes an encircling outward opening channel 16. Under the channel 16 is a second inward opening channel 18 generally conforming in size and shape to the channel 16 which, when the cover 10 is positioned on a ladle, sits on the top wall of a ladle 30 as shown in FIG. 2. The channel 18 interior is filled with insulation 19.

A generally flat sheet 20 of expanded metal is secured to the top surface of the channel 16 and spans the space defined by the channel 16. This sheet 20 serves to secure in place an insulating assembly 14 which fills the space or volume under the expanded metal 20 to slightly below the approximate depth of the channel 16. The framework 12 also includes a pair of main brace members 24, 26, each of which has symmetrical sides which extend radially from the approximate center of the cover 10. Each of members 24 and 26 is preferably made being centrally vertically notched to receive and intersect with one another at the center of the round cover 10 and they are welded to each other at that point. The brace members 24 and 26 are each made from a single sheet of structural steel and are of identical overall shape and terminate with legs 29 which, as shown in FIG. 2, serve to aid in aligning the cover 10 on the top surface of the conformingly sized and shaped ladle 30. The main braces 24 and 26 are preferably cut to conform to the outer surface of the channels 16 and 18 and secured by being welded to them. The use of radial main structural elements provides a more rigid cover and the novel use of the same unit for both structural support and to form the alignment legs 29 saves considerable time and effort in assembling the cover 10. The expanded metal sheet 20 is also preferably secured by spot welds to the underside of the members 24, 26, as well as to the top of the channel 16. A suitable lifting grasp member e.g. a bail (not shown) is preferably secured to the members 24 and 26.

Ladle covers can commonly be completely removable or can be hinged at one side, and the cover 10 may be either. For example, a conventional hinge could be secured to one edge of the cover, preferably centered between adjacent alignment members 29. Ladle covers can also be removed by different hoisting or pivoting mechanisms. The cover 10 can easily be adapted to the existing lift system used by any particular shop. As such systems are varied and well known, they are not detailed here.

The framework 12 further includes a number of generally square tubular reinforcing members 34 in a pair of concentric squares, with members 34A spanning between the members 24 and 26 at about one-third of the distance from their intersection, and members 34B at about two-thirds of that distance. Additional members 34C are preferably provided extending radially from the centers of the members 34B to a point atop the channel member 16 midway between the members 29. The number and arrangement of such reinforcement members 34 will, of course, depend on the size and shape of the particular ladle to be covered by the cover 10. The arrangement of FIG. 1 is suitable for 13½ foot diameter cover, as will be detailed further below. The expanded metal sheet 20 is also secured, preferably by spot welding to the reinforcing members 34.

In accordance with a major principle of the present invention, the cover 10 is provided with a unique lightweight insulation assembly 14 made of modules of a unique design affixed in a novel manner. The assembly 14 includes a plurality of side-by-side modules 50 all parallel to one another and aligned at an angle to all of the main straight members of the framework.

Figure 3:
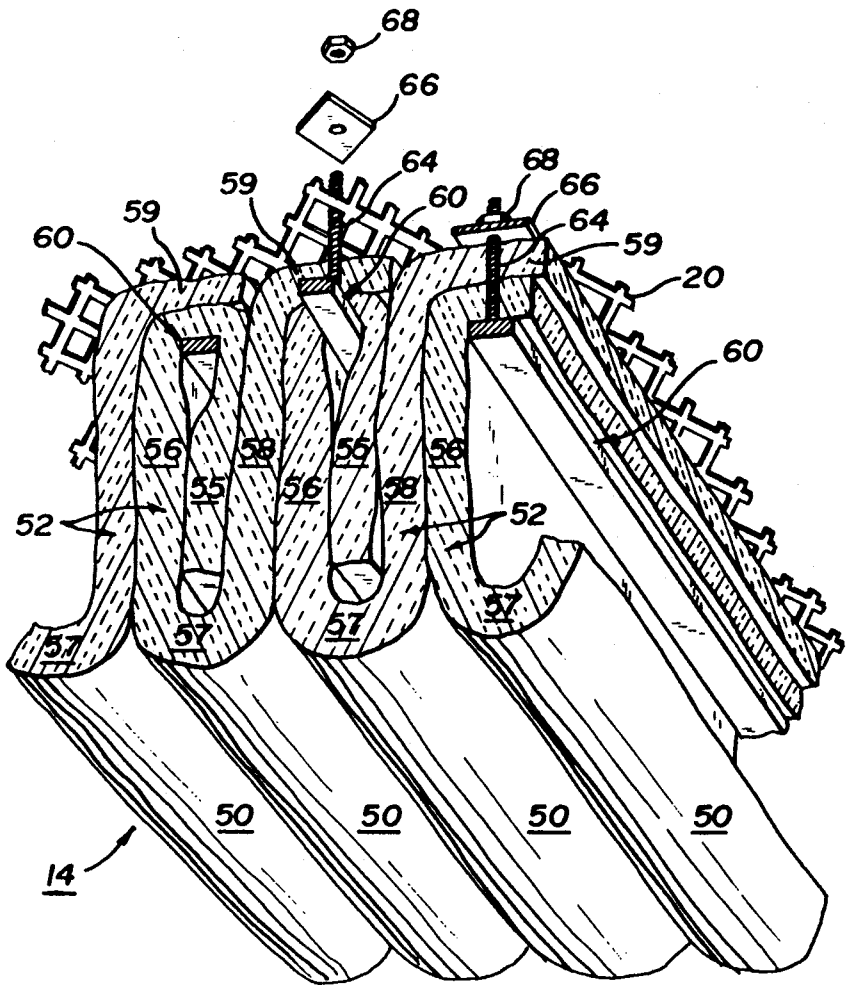
FIG. 3 is an enlarged perspective view of a portion of the ladle cover of FIG. 1 with parts broken away to illustrate internal construction.

As best shown in FIG. 3, the modules 50 include a folded ceramic insulating batting or mat 52 folded into a unique tri-vertical layer and horizontal extension arrangement, wherein (with the exception of the last module in the assembly 14) each mat of each module 50 is secured by not one but two bar securing units 60. Yet, approximately only one bar anchoring unit is required per module.

The mats 52 are each generally flat, flexible, rectilinear-when-unfolded units (FIG. 4) which are cut to a width depending upon the length of the module 50 in the cover 10 and a length of about three and one-half times the desired depth of the assembly 14. The mat 52 preferably has a normal uncompressed thickness of approximately one inch.

Figure 4:
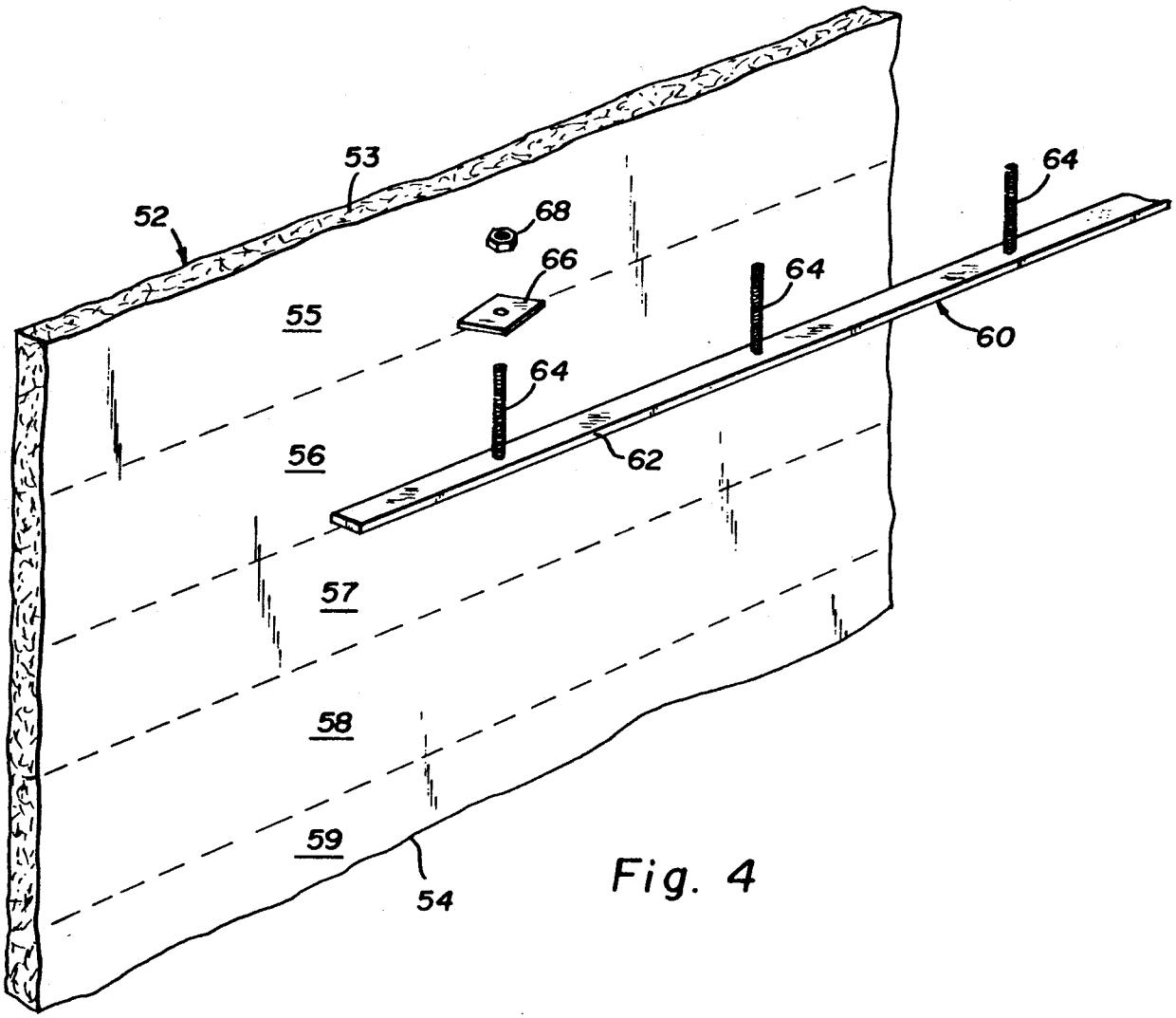
FIG. 4 is a perspective view of the components of an insulation module of the present invention.

The mats 52, when unfolded, FIG. 4, have two transverse ends 53, 54 and can be considered to have five sections defined by the future folds indicated in FIG. 4 by the dashed lines. The first section forms the vertical internal section 55 of the finished module 50 (FIG. 3). The next section 56 forms the left vertical section, and the next adjacent section 57 serves to provide the "hot" surface of the module 50. The next section 58 serves as the right vertical portion of the module 50, with the sections 56, 57 and 58 forming a general U-shape configuration with the end section 55 sandwiched in between the legs of the U. A last section 59 serves as the horizontal section which overlaps and overlays the next module to the right.

As also shown in FIGS. 3 and 4, unique anchoring units 60 comprise a flat bar 62 with threaded shafts or studs or bolts 64 secured in a spatial array to one flat side of the bar 62. This is preferably done by employing a stud welder such as the Nelson ® Stud Welding system made by the TRW Nelson Stud Welding Division of TRW, Inc., 7900 West Ridge Road, P.O. Box 4019, Elyria, Oh., 44036-2019, and described in that firm's publication "TRW Nelson Stud Welding System-Shield (1989)." A typical bar 62 would be of malleable steel ¼ inch thick and ½ inch wide. The bolts or threaded studs 64 would be ¼ inch or 3/16 inch diameter studs about three to four inches in length. The studs are, as shown, attached only to one flat side of the bar 62 at a convenient spacing such as every 12 inches. The studs are fastened after passing them through the opening in the expanded metal wall 20 by the use of fasteners such as the depicted washers 66 and nuts 68.

Method of Assembly

The insulation assembly of present is an inventive feature which may be applied in making ladle covers such as the cover 10 but may also be applied on other insulation assemblies such as furnace wall constructions. The method of assembly is the same for both a furnace wall as for a ladle cover. Preferably, either construction is assembled with the framework of the cover or wall constructed first and being positioned generally vertically.

Figure 7:
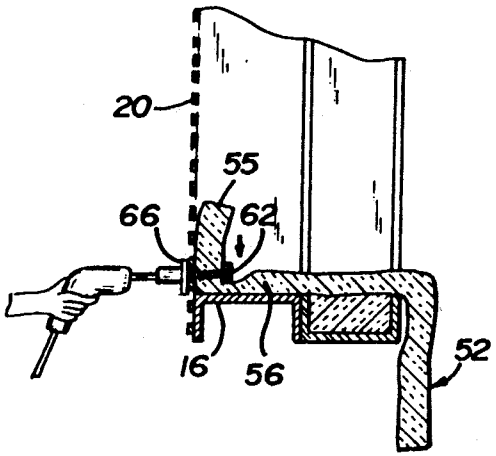
FIG. 5 through FIG. 14 illustrate steps in the process of assembling a series of intercoupled insulation modules in accordance with the present invention.
Figure 6:
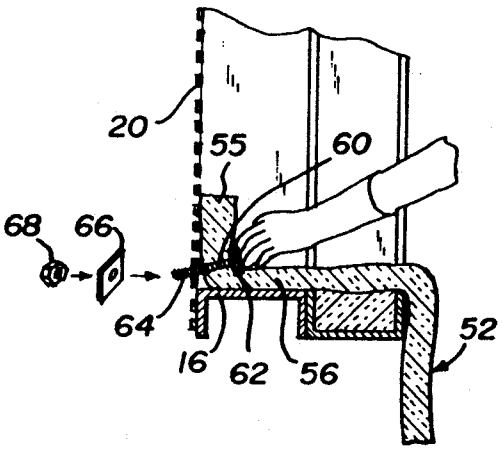
Figure 5:
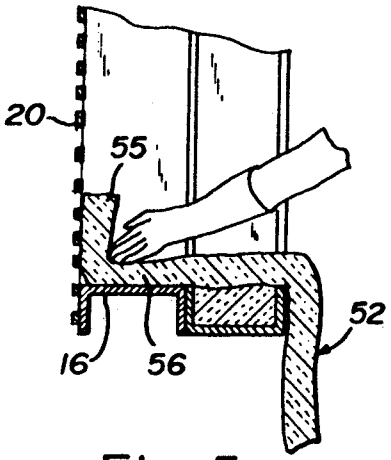
Figure 9:
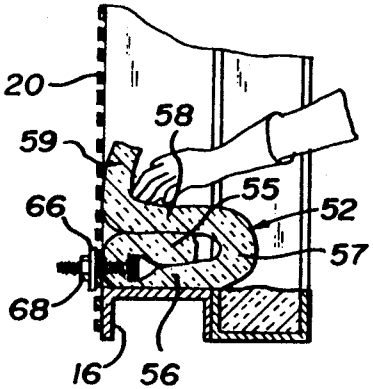
Figure 8:
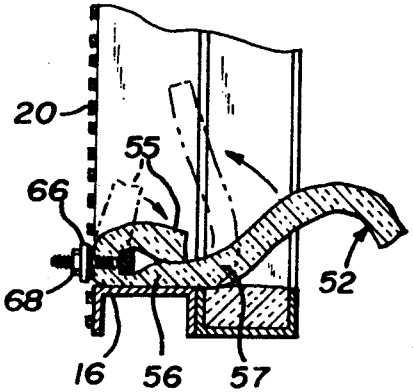

The initial mat 52 is pressed (FIG. 5) snugly into the cover formed between the frame unit 16 and the attached expanded metal wall 20 so as to have the section 55 against the expanded metal and the section 56 against the frame unit 16. A unit 60 is moved into engagement and its studs 64 pushed through to pierce the mat 52 and thence pushed through openings in the expanded metal (FIG. 6). Note that the studs are directed at a downward angle. The inserted anchoring unit is thereafter secured in place by a nut 68 and washer 66 (FIGS. 6 and 7). In tightening the nut 68, the nut 68 and washer 66 draw the bar 62 downward and compress the batting between it and the frame member 16. The section 55 is now folded down and pressed against the section 56 (FIG. 8), and section 57 is raised and folded over to sandwich the section 55 between it and the section 56 (FIG. 9), and the section 59 pressed against the vertical wall 14.

Figure 10:
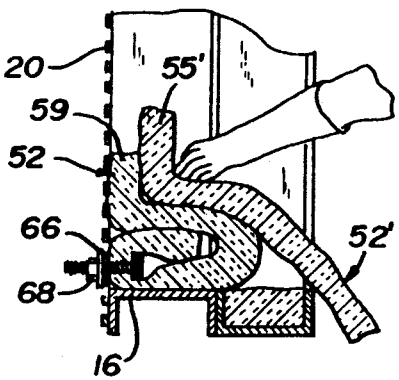
Figure 13:
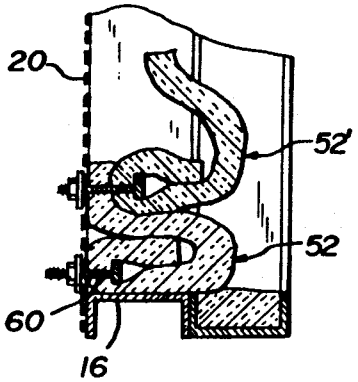
Figure 12:
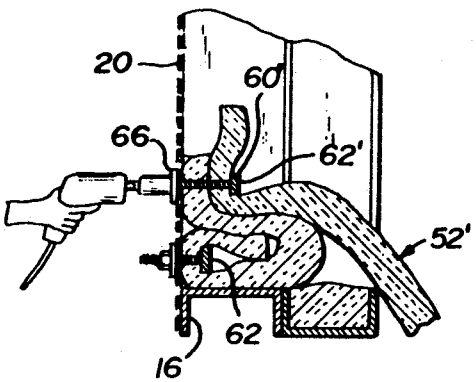
Figure 11:
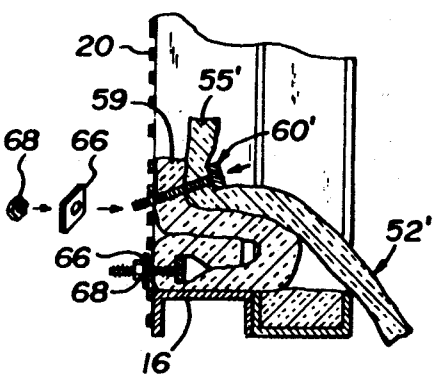
Figure 14:
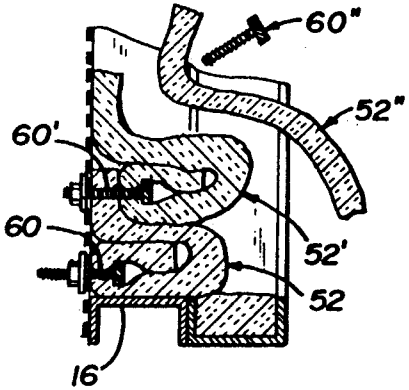

At this point, a second mat 52' is placed (FIG. 10) with its section 55' against and overlapping the section 59 of the first mat. The section 55' of the second mat 52' overlaps the section 59 of the first mat 52 vertically by about twice the thickness of the mats. The remainder of the mat 52' may be draped downward, as shown in FIG. 11. A second anchoring unit 60' is now pushed into place (at a downward angle) with its threaded studs 64 piercing both the section 55' of the second mat and the section 59 of the starter mat (FIGS. 11 and 12). It is there secured in the same manner as the first anchor unit 60 (FIGS. 13 and 14). This results in a compression downward of the mats between the bar 62' and the bar 62. The sections 55', 57' and 59' are folded as before and a new mat 52'' placed in the same manner. The process is repeated adding adjacent mats and anchoring units in the same wall until the insulation assembly 14 is completed.

When employed in an oval or circular ladle cover such as the cover 10 of FIG. 1, as the layers build up, the length across the cover increases and then decreases. The mats 52 and units 60 are made to conform. (In general, the compressive nature of the mat is such that it is not necessary to cut each section of each mat to conform to the relatively small change in length encountered between its sections but such can be done if desired. For example, the mats could be cut in a trapezoidal shape with the length of the top 53 being less than that of the bottom 55 for the initial units, with the reverse arrangement for the final units.) The final unit may have the section 59 cut off or folded back parallel with the section 55 as desired.

One major advantage of this method and structure is that the resulting unit provides less gas infiltration without the need of a separate overlayer as has been commonly used heretofore with other types of modules. It is normal for heated gases to attempt to pass through the cover. While a limited amount of infiltration is acceptable and even desirable when it serves to limit gas pressure under the cover, the opening of a flow pathway through the modules, e.g. between adjacent surfaces of mats, is to be avoided. Such pathways not only lead to unacceptable heat loss but tend to increase in size over time and eventually require that the cover be relined or replaced.

Figure 15:
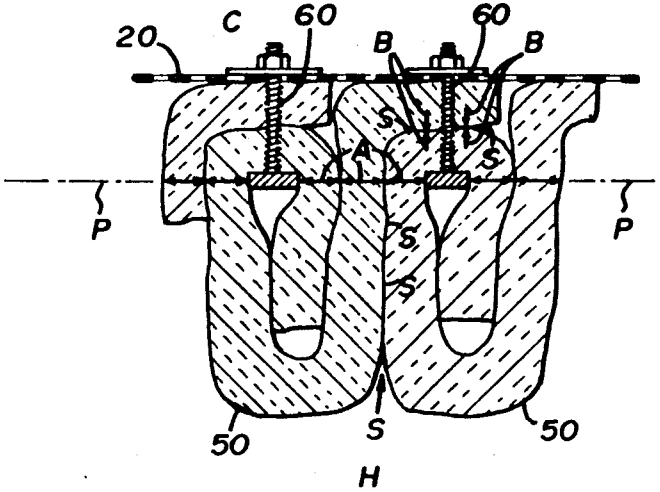
FIG. 15 is an enlarged scale cross sectional view of a portion of the finished assembly of FIGS. 1–14 illustrating by arrows the compression of fiber mats against one another resulting from the assembly.

The arrangement of the present invention as shown, for example, in FIG. 15 has no direct vertical pathway between units for such an opening to develop. Further, the compressing of the units 60 tends to close the indirect pathway between adjacent mats. Further, the use of wide fold bars in a side-by-side parallel array and in approximately the same plane (P in FIG. 15) causes a relative compression of the batting between the bars as shown by the arrows A. This also tends to stop passageways from developing. The use of a flat bar provides a greater width and thus serves to compress transversely a greater distance than a round rod of equal weight. The primary path for large volume gas escape from the hot side (H in FIG. 15) to the cold side (C in FIG. 15) is between the mats of adjacent modules 50; that is, through the surface S in FIG. 15. Note that the compressing by the anchoring unit 60 tends to stop gas flow through pathway S by compressing the mats together horizontally at arrows A as well as compressing the mats together vertically at arrows B.

Note that the modules are compressed by the process of tightening the anchoring units in place. That is, as shown, for example, in FIG. 11, the unit 60 is inserted so that the studs 64 are angled downward into openings in the wall 20. When the washer and nut are applied and tightened as shown in FIG. 12, the bar 62 is pivoted downward by the action of the tightening nut 66 on the washer 64 and wall 20 to compress the sections of mat between it and the bar below it. This provision for automatic compression is one advantage of the present anchoring system over the wire ties and round rod of some prior art systems.

For purposes of illustration and definiteness of description but not for limitation, the following dimensions and materials for one example of a ladle cover construction are set out. As stated before, the invention is broad and can be employed in many ways and structures. One exemplary cover such as that illustrated in FIG. 1 would have an overall diameter for the curving channels of 13½ feet. The fiber mats assembly would then extend about 9 inches from the expanded metal wall 20. That wall would be made of unflattened expanded metal 1 inch×3 inches, diamond pattern—3.14# per foot. The mats are initially one inch thick and 24 inches long with the width cut to fit. The mats are made of ceramic fiber and one currently commerically available mat is CerWool ® HTZ, No. 174630, available from Premier Refractories of 901 E. 8th Avenue, King of Prussia, Pa., 19406.

The diamond shaped openings of the expanded metal and the spacings of the studs 64 are preferably related so that the studs will seat at a corner of the openings when the units 60 are seated. The pattern of diamond shaped openings is preferably the same across the entire wall 20 and is angled so as to be at an angle to all major structural supports and to thus allow easier access to the placed studs from the "cold" side of the cover during assembly. The washers 64 are sized so that they will span across a diamond opening and rest flat against the corresponding portions of the expanded metal on opposite sides of the opening.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. The process of making a heat insulating assembly for an insulating structure of the type that has a wall adjacent to the insulation assembly that is to be provided, employing a plurality of mats of spun ceramic fiber material, each of which mats has a predetermined length, width and thickness and is capable of being folded between a plurality of adjacent sections, including a first end section and a last end section; and a plurality of anchor units made of elongated bars having elongated studs secured in a spaced array along the bars, the studs having one longitudinal end secured to the bar and the other end adapted to receive fastener means, all of the studs secured to a bar being aligned with one another and projecting in the same direction on the same side of the bar; and fastener means for securing to the studs when projected into the wall and for preventing inadvertent removal of the studs from the wall; comprising the steps of:

(a) placing a mat against the end section of a mat, which end section is against the wall, said placed mat being positioned so that the junction between its first end section and second section are against the cold side of said end section of the mat section against the wall;

(b) placing the anchoring unit along the junction of the placed mat and pushing the studs thereof through both said placed mat and the mat section against the wall to pierce both to pass into the wall;

(c) securing the studs of the anchoring unit passed into the wall with the fastener means so as to sandwich both mats between the wall and the bar of the anchoring unit;

(d) folding the first section of said newly placed mat to extend away from the wall in an approximately vertical arrangement while folding the next adjacent sections of the mat into a generally U-shape about the end section and placing the end section of the mat horizontally against the wall to form a section for receiving another mat; and (e) repeating steps (a) through (d) until the assembly is substantially formed.

2. An insulation module in insulating structures having a cold side and a hot side, the module being fastened to form at least in part the hot side of the insulating structure, said insulating module comprising:

a mat of fibrous resilient ceramic fiber insulating material formed in folded condition in said module with successive contiguous mat sections as follows: a first section arranged to extend at an approximately right angle to said sides of the structure followed by a generally 180° fold to a second contiguous section which lies parallel and adjacent the first section, the fold between said sections serving to receive a longitudinal bar extending along said fold, a further third section folded across the end of said first section and forming part of the hot side of the structure, a fourth section folded parallel to and adjacent said first section, said second, third and fourth sections forming a general U-shaped cross section with said first section sandwiched between said second and fourth sections and in the opening of said U-shape, a fifth section contiguous to said fourth section and folded to be at approximately a right angle to said first, second and fourth sections and to extend parallel to the sides of the structure and extend for a distance from the fourth section, which distance is approximately equal to the thickness of said folded together first, second and fourth sections so said fifth section is able to provide a layer of mat for overlaying a portion of an adjacent similarly constructed module; and anchoring means including a bar placed at said 180° fold between said first and second mat sections and including means passing through said mat for being secured to the cold side of the insulated structure.

3. The module of claim 2 wherein said bar of said anchoring means is generally flat with a length many times its width and a thickness less than its width and has a flat surface facing the cold side, and said anchoring means further includes a plurality of studs having two longitudinal ends, said studs each having one end secured to said cold side facing flat surface of said bar at spaced intervals along the length of said bar, which studs pierce and pass through the mat and into the cold side;

said module including fastener means for captivating the studs of said anchoring means and securing it and the pierced mat to the cold side.

4. The module of claim 3 wherein said studs are threaded and said fastener means includes nut means threadably receivable on said threaded studs.

5. In an insulating structure having a cold side and a hot side, the improvement comprising successive adjacent insulation modules being fastened to form at least in part the hot side of the insulating structure, said insulating modules including a first insulating module which comprises:

a mat of fibrous resilient ceramic fiber insulating material formed in folded condition with successive contiguous mat sections, one of which sections forms a part of said hot side and another of which sections extends parallel to the cold side of the structure for a distance which is at least approximately equal to the thickness of said one section forming part of the hot side, so as to form an overlaying section to part of a second mat;

a second module comprising a second mat of fibrous resilient ceramic fiber insulating material formed in folded condition and substantially underlying said another section of said first mat of said first module, said second mat with successive contiguous second mat sections, one of which second mat sections forms another part of said hot side adjacent to said hot side part formed by said first mat of said first module and substantially under said another section of said first mat of said first module and said second mat, including another section of said second mat which extends parallel to the cold side of the structure for a distance, which distance is at least approximately equal to the thickness of said second one mat section, and said second another section of said second mat, forming another overlaying section and anchoring means for said second module including means passing through said first and said second mats for being secured to the cold side of the insulated structure.

* * * * *